US005152593A

United States Patent [19]

Domenig

[11] Patent Number: 5,152,593

[45] Date of Patent: Oct. 6, 1992

[54] CABINET ASSEMBLY SYSTEMS

[76] Inventor: Georg Domenig, 2026 Twin Pines, Kernersville, N.C. 27284

[21] Appl. No.: 602,548

[22] Filed: Oct. 24, 1990

[51] Int. Cl.[5] ..... A47F 5/08

[52] U.S. Cl. ..... 312/245; 248/205.2

[58] Field of Search ..... 248/205.2, 489; 24/205.2, 442, 443, 444; 312/198, 203, 245, 246; 52/DIG. 13

[56] References Cited

U.S. PATENT DOCUMENTS

| | | | |
|---|---|---|---|
| 3,370,818 | 2/1968 | Perr | 248/205.2 |
| 3,732,600 | 5/1973 | Perina | 24/444 |
| 3,777,435 | 12/1973 | Perina | 52/DIG. 13 |
| 3,950,049 | 4/1976 | Drass | 312/198 |
| 3,974,548 | 8/1976 | Meiel | 24/444 |
| 4,279,397 | 7/1981 | Larsson | 312/245 |
| 4,329,003 | 4/1982 | Manchester | 312/263 |
| 4,735,317 | 4/1988 | Sussman | 248/205.3 |
| 4,870,725 | 10/1989 | Dubowik | 24/442 |

*Primary Examiner*—Gerald A. Anderson

[57] ABSTRACT

A cabinet assembly system incorporating fastener elements of the hook and loop type or their equivalent particularly designed and positioned to enable the supporting walls, floor and ceiling of a given area to support, temporarily or permanently in pre-selected locations, a plurality of cabinets, shelves, receptacles and the like, having walls, tips, doors and floors. The fastener elements are affixed to walls, floor and ceiling as needed and to the contiguous surfaces of cabinets, shelves and receptacles directly or with special fastening elements so that these articles can be maintained in an established configuration until more secure fastenings are effected or until there is a decision to rearrange the configuration.

2 Claims, 4 Drawing Sheets

CABINET ASSEMBLY SYSTEMS

BACKGROUND OF THE INVENTION

1. Field of the Invention

This invention relates to cabinet assembly systems and more particularly to a cabinet assembly system incorporating loop and hook elements or their equivalent to hold one or more cabinets in a selectively positioned arrangement against supporting surfaces.

2. Description of the Prior Art

Various types of devices have traditionally been used to mount cabinets, shelves or receptacles to supporting surfaces such as walls, ceilings and floors in the construction of kitchens, dens and storage rooms. The most common practice is to secure the cabinets directly to the supporting surface by nails or screws. This is often difficult to accomplish, particularly when limited manpower to only one individual is available for the installation because a cabinet may change position as it is being affixed to the supporting surface thereby requiring disconnection and repositioning several times before a satisfactory arrangement is achieved. Relying upon this practice, slightly off centered or less than desired positioning is accepted when a more precise configuration is obviously desirable.

There are numerous brackets and fastening elements available for mounting cabinets to supporting surfaces. The installer positions one component of such elements on the supporting surface and a mating or cooperating component to the engaging surface, usually a wall of the cabinet. This technique is more manageable with limited manpower since the installer is not required to support the weight of the cabinet while mounting the components of the brackets and fastening elements to the cabinets and supporting surfaces. On the other hand, the use of such devices is expensive, they being often intricate in design and enhanced with various adjustable features.

While prior art techniques of installing cabinets and generally comparable devices to supporting surfaces are more or less satisfactory, they are time-consuming, particularly when installation is to be done with limited manpower, and expensive because of the design of the elements involved. Moreover, the installation is, for the most part, permanent once completed since the supporting surfaces are marred with either holes from nails and screws used to make the attachment or distressed because of the positioning and subsequent repositioning of brackets and fastening elements thereon. For that reason, cabinets are seldom moved from place to place in a completed installation unless the entire area is renovated, thus eliminating the marred surfaces and distressed areas previously described.

From the foregoing, there is perceived a need for a cabinet assembly that can be easily and quickly and temporarily or permanently installed, that can be varied in arrangement from time to time without undertaking a total renovation of the area of installation, that is less costly than utilizing the elements available at the present and that can be effectively utilized with limited manpower of even a single individual. Alternatively, there is demonstrated the need for a cabinet assembly system that will permit the precise arrangement of a cabinet configured area before permanent installation of the system is effected.

SUMMARY OF THE INVENTION

The present invention is a cabinet assembly that includes one or more cabinet supporting surfaces; i.e., walls, floor and ceiling, and one or more cabinets having walls, tops and floors, the cabinets being affixed to the supporting surfaces in a pre-selected configuration. A plurality of discreet spaced fastening devices incorporating loop and hook elements or a strong double-sided tape are secured selectively to cooperating supporting surfaces and cabinet walls, tops and floors. The elements secured to the supporting surfaces cooperate with the elements secured to the cabinets to support the cabinets on the supporting surfaces and inhibit relative movement therebetween.

With respect to the hook and loop fastening elements, one is formed of a plurality of resiliently deformable loops and the other is formed of a plurality of resiliently deformable t-shaped hooks adapted to hook into the loops to secure the cabinet to the supporting surface. The hooks and loops, when pressed against each other, become virtually fixed, although they are susceptible to separation thereafter without damage to either element.

To facilitate securement of the fastening elements to each other, it has been found advantageous in some situations, to utilize a grooved cabinet affixed member and a separate independent surface mounted U-shaped member to support the elements in a strengthened and enhanced manner.

The assembly can be utilized to form a stable and permanent installation for continuous use thereafter or can be used to pre-position various cabinets in an assembly at desired locations so that subsequent and more permanent attachments can be made by conventional means.

BRIEF DESCRIPTION OF THE DRAWINGS

Other objects and features of the present invention will become apparent from the following detailed description taken in conjunction with the accompanying drawings wherein like characters of reference designate like parts throughout the several views, which drawings disclose at least one embodiment of the invention. It is to be understood, however, that the drawings are designed for the purpose of illustration only and are not intended as a definition of the limits of the invention.

DETAILED DESCRIPTION OF THE PREFERRED EMBODIMENT

Figure 1:
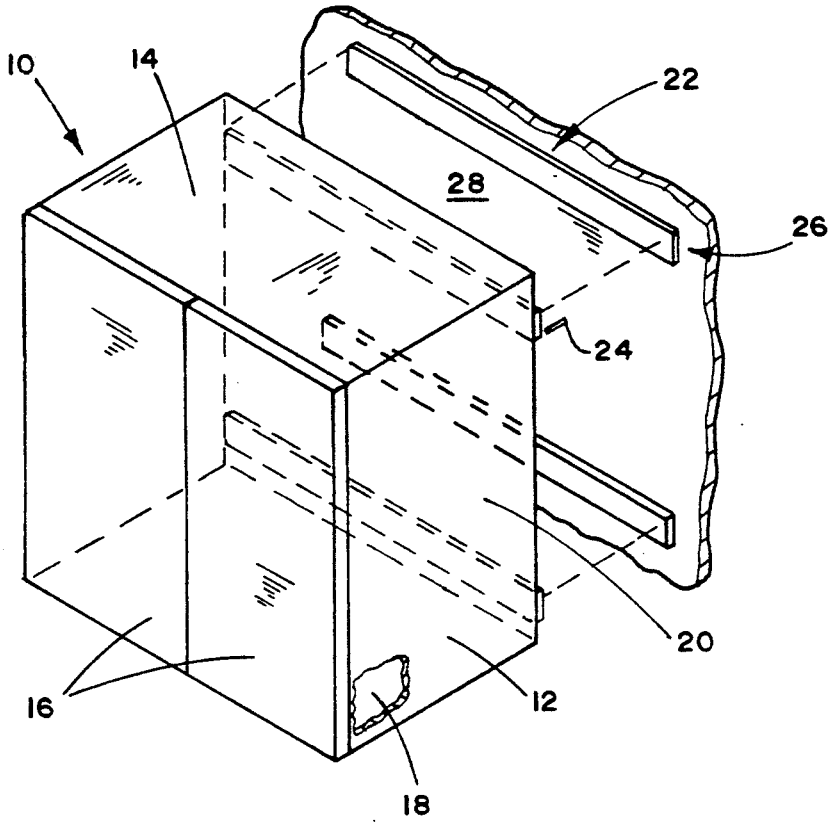
FIG. 1 is a perspective view of a wall hung cabinet being mounted as a part of the cabinet assembly system comprising the present invention.
Figure 2:
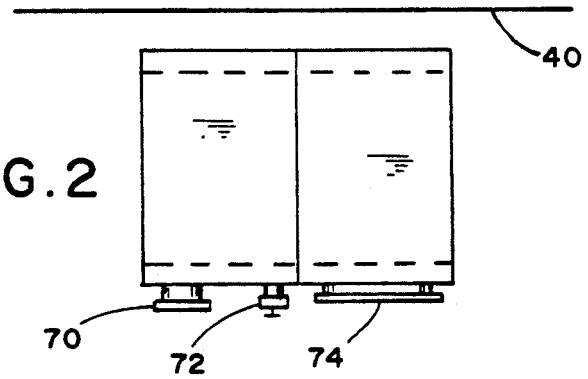
FIG. 2 is a front elevational view of an overhead cabinet installed in accordance with the present invention.

Referring now in detail to the drawings and particularly to FIG. 1, the cabinet shown generally as 10 has sides 12, top 14, doors 16, and floor 18 all securely fastened to a back 20. A fastening element shown generally as 22 has a looped member shown generally as 24 and a hook member generally shown as 26 fastened directly to back 20 and wall 28 (FIG. 3) respectively. The looped member 24 contains a plurality of resiliently deformable loops 30, and the hook element is in the form of a plurality of resiliently deformable T-shaped hooks 32 adapted to hook into loops 30 to secure the two elements together and form the fastening element 22 in total. When the hook and loop members 24, 26 are secured to cabinet back 20 and wall 28, the elements cooperate to affix the cabinet to the wall and inhibit relative movement between the cabinet and that supporting surface.

Other securing means may be used including a double-sided adhesive tape that functions similarly to the hook and loop elements. The examples discussed herein will be associated with the hook and loop elements.

Figure 3:
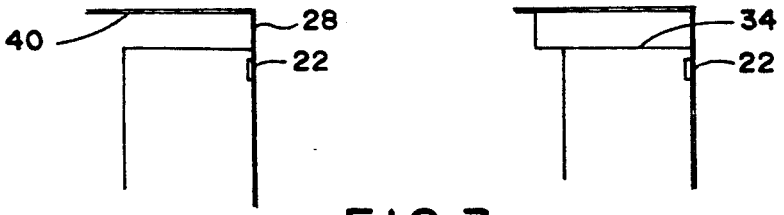
FIG. 3 is a side elevational and sectional view of an overhead cabinet installed in an open ceiling configuration and then in a closed or boxed ceiling configuration in accordance with the present invention.
Figure 4:
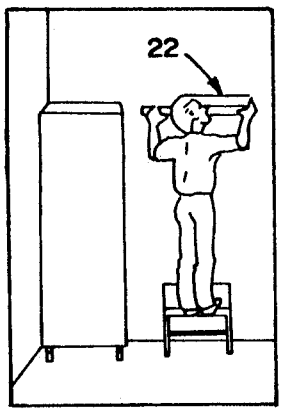
FIG. 4 is a perspective view of the installation of a hook and loop configuration on which to mount the assembly system comprising the present invention.
Figure 5:
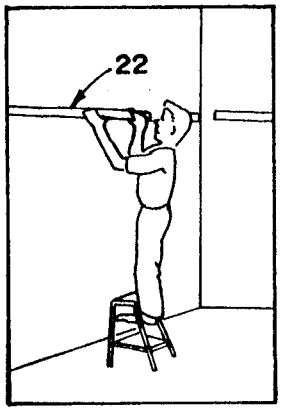
FIG. 5 is another perspective view of continuing the installation of the hook and loop assembly upon which to mount the cabinet assembly comprising the present invention.
Figure 6:
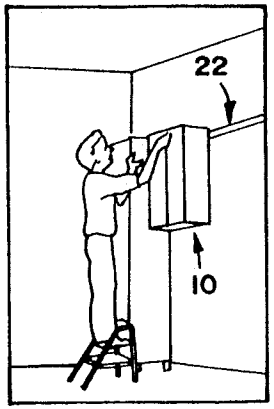
FIG. 6 is another perspective view of actually connecting a cabinet to the hook and loop adhering means positioned on a wall of a supporting surface.
Figure 7:
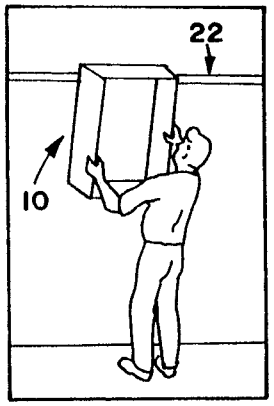
FIG. 7 is another perspective view of the same operation shown in FIG. 6.
Figure 8:
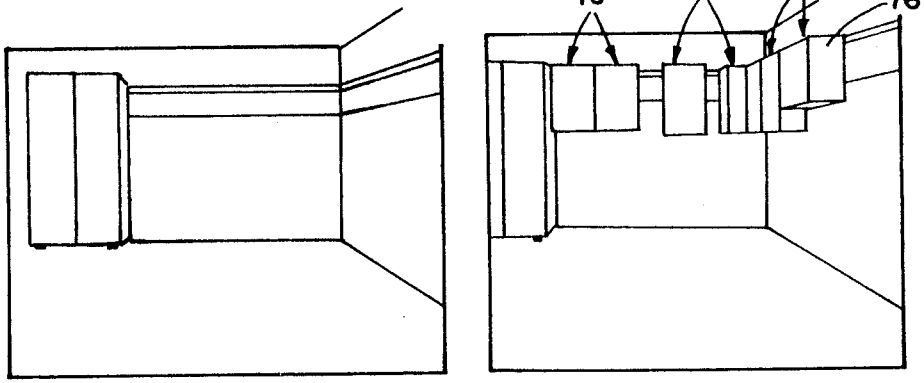
FIG. 8 is a perspective view of a kitchen at the beginning of the installation of the assembly comprising the present invention.
Figure 9:
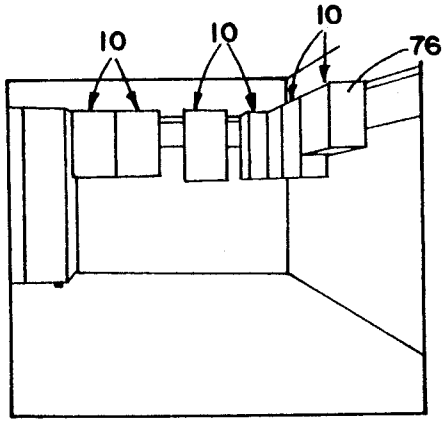
FIG. 9 is a perspective view of a kitchen wherein numerous cabinets have been installed utilizing the cabinet assembly system of the present invention.
Figure 10:
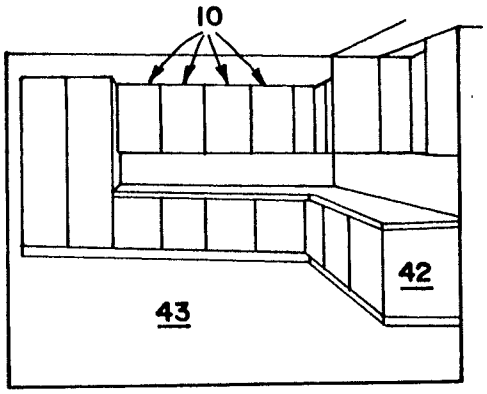
FIG. 10 is a perspective view of a completed kitchen including various cabinets installed in accordance with the cabinet assembly system comprising the present invention.
Figure 20:
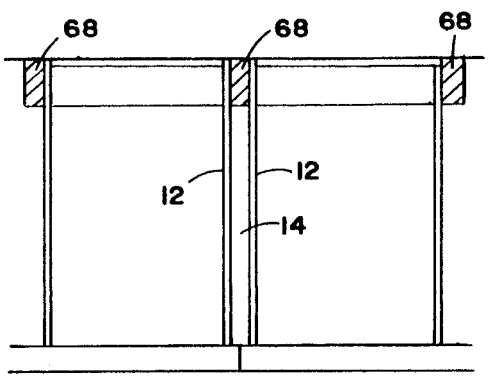
FIG. 20 is a front elevational and section view of two cabinets fastened to a stabilizing surface upon which is mounted the U-shaped member with spacers of FIG. 19, the spacers being discreetly positioned to separate the walls of the cabinets thereby stabilizing the assembled structure.
Figure 19:
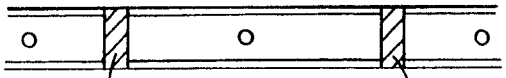
FIG. 19 is an expanded front elevational, fragmentary and sectional view of the U-shaped member of FIGS. 16 and 17 having a plurality of spacers dividing the member into separate units.

The fastening elements 22 can be positioned at strategically selected, load-supporting locations which are hidden from view when the cabinets have been installed. For example, fastening elements 22 can be secured to the back and supporting walls as shown in FIG. 1, to the top 34 as shown in FIG. 3 or to the ceiling 40. Moreover, the present inventive concept can be utilized to anchor cabinets 42 to the supporting floor 43 as shown in FIG. 10. In all of the examples given, it is apparent that a configured area may be designed in a particular way by the specific positioning of the fastening elements 22 and later reconfigured efficiently and without substantial wall, ceiling or floor distress to suit the needs and desires of the user. The present inventive concept can be utilized to establish permanent configured arrangements or can be utilized to pre-position a cabinet configured area so as to hold it in a desired configuration until permanent fastening elements are applied.

Figure 11:
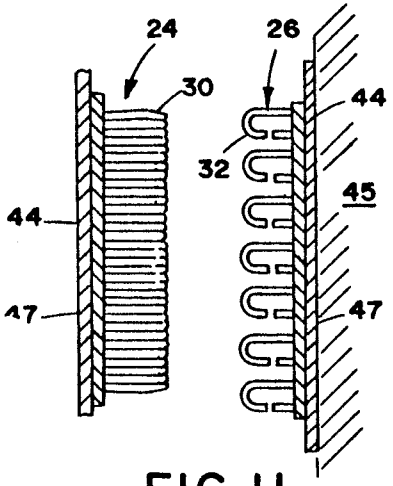
FIG. 11 is an enlarged side elevational view with parts and cross-section illustrating the fastening means positioned in an oppositely disposed relationship.

The fastening elements made up of the hook and loop components 24,26 may be formed by the utilization of "Velcro" fastening strips 44 secured to the wall 45 by a two-faced adhesive tape or the like such as shown in FIG. 11.

Figure 12:
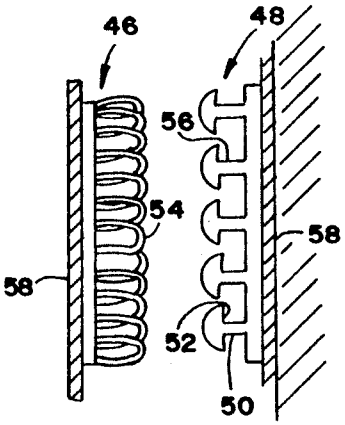
FIG. 12 is a side elevational view of another version of the loop and hook members of the fastening means for fastening cabinets on supporting surfaces.
Figure 13:
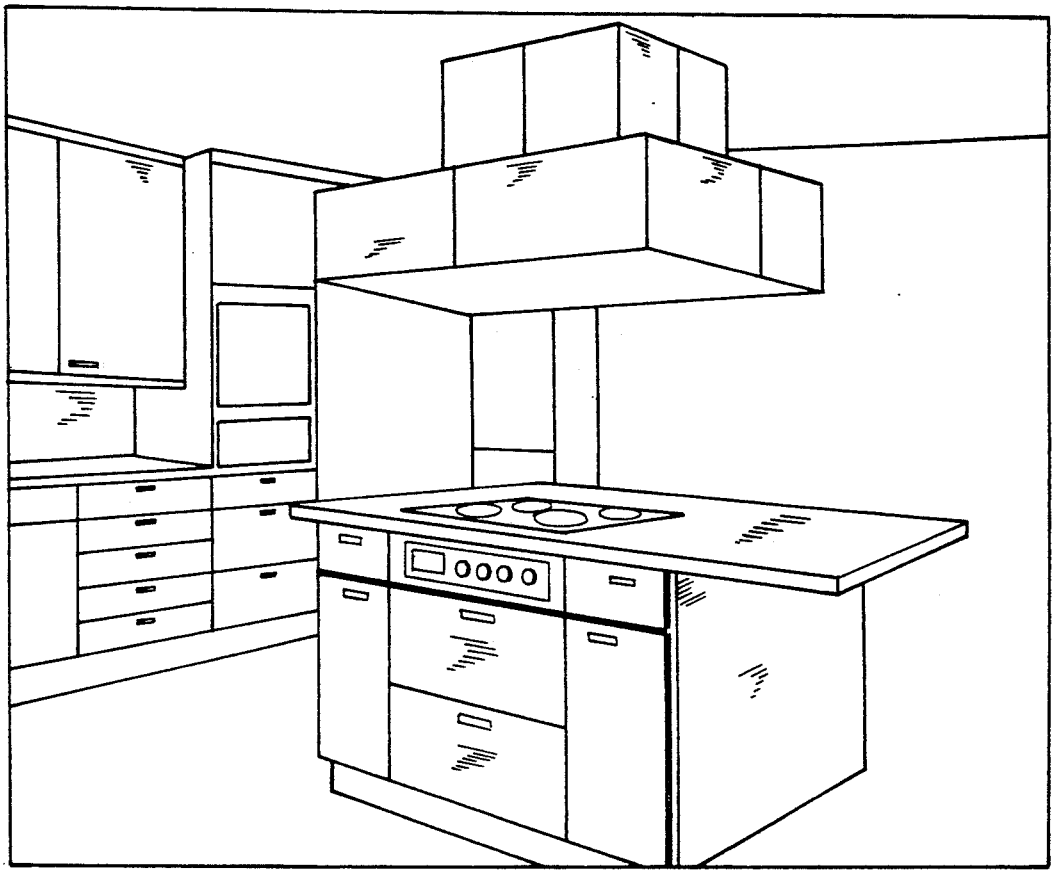
FIG. 13 is a perspective view of another kitchen cabinet arrangement utilizing the system comprising the present invention.
Figure 14:
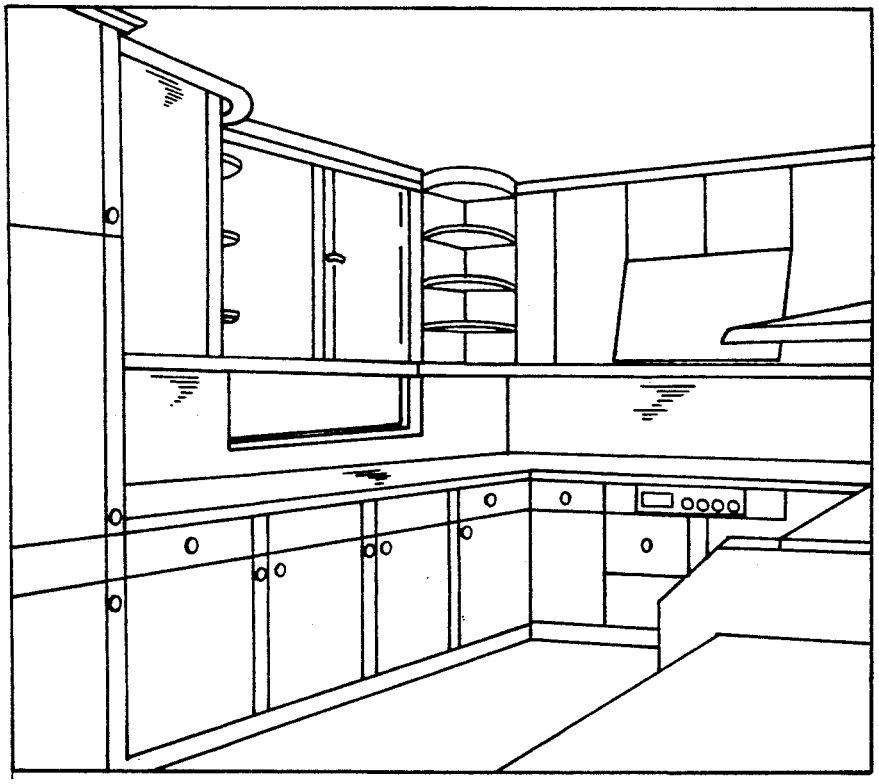
FIG. 14 is a perspective view of yet another kitchen cabinet arrangement embodying the system of the present invention.

An alternative configuration is shown in FIG. 12 wherein a conventional loop member shown generally as 46 of the Velcro type is made, for example, of nylon and cooperates with a T-shaped hook member generally shown as 48 of formed plastic material. The T-shaped hooks 50 of member 48 are relatively rigid and are each undercut on opposite sides as indicated at 52 to lock with the loops 54 of the loop member 46. The height of a stem 56 of T-shaped hooks 50 should be short so that the cabinet back and supporting wall are close together. The shorter the stems and loops can be made, the less opportunity for relative movement. Again, a two-faced adhesive tape 58 may be used to preposition the loop and hook members 46,48 at selected locations on the walls and cabinets.

Figure 16:
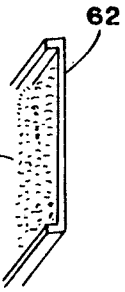
FIG. 16 is a perspective and fragmentary view of a U-shaped member 62 which is malleable to a supporting surface and which houses a cooperating segment of hook or loop element.
Figure 17:
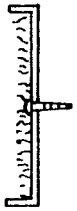
FIG. 17 is a side elevational and sectional view of the U-shaped member of FIG. 10 which is fastened to a supporting wall by a screw.
Figure 15:
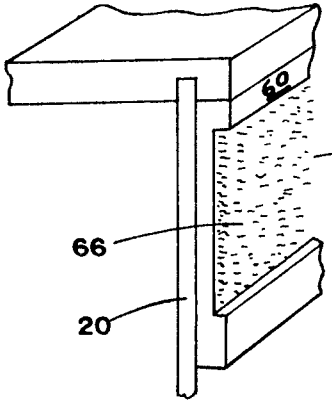
FIG. 15 is a perspective, enlarged and fragmentary view of a grooved member affixed to the back of a cabinet in which is supported a section of hook or loop material.
Figure 18:
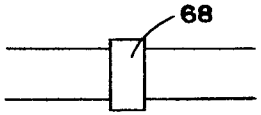
FIG. 18 is a front elevational and fragmentary view of the U-shaped member of FIGS. 16 and 17 equipped with a spacer.

To make certain that a positive securement of the fastening elements to each other occurs, it has been found advantageous to utilize a grooved cabinet affixed member 60 (FIG. 15) and a separate independent surface mounted U-shaped member 62 (FIG. 16) to support the elements in an additionally strengthened and enhanced manner. Member 62 may be made of metal, wood, plastic or other like materials. If a cabinet is to be affixed to the wall in close proximity to its back surface 20, the grooved member 60 can be affixed to the cabinet back 20, Velcro material 64 applied within the groove itself which is dimensioned to cooperatively receive the U-shaped member 62 and its Velcro element 64. The grooved member 60 can be fastened to the cabinet back 20 or to another surface of the cabinet itself such as the top or the bottom. The U-shaped member 62 is an extruded or stamped element made of metal, plastic or other suitable material of a dimension to be accepted within the channel 66 of member 60. When the members 60,62 are joined so that member 62 is positively engaged within groove 66, an enhanced securement between the elements is achieved thus making the entire fastening assembly a more positive and secure arrangement.

In renovation projects utilizing the present invention, it may be necessary to insert shims under the wall mounted U-shaped member 62 compensate for uneven wall surfaces and ensure that consistent positive engagement between Velcro element 64 is achieved.

Many cabinet systems, especially face-frame cabinet systems, embody frame cabinets wherein two cabinet side walls 12 are placed next to each other as cabinets are assembled with a space 14 therebetween. In such systems, it is necessary to provide spacers to make certain that the void is substantially filled and that the entire cabinet assembly remains stable. In the present inventive concept, the U-shaped member 62 can be intermittently provided with spacers 68 which are adjustably securable thereto to provide the necessary reinforcement between the two cabinet walls 12. The U-shaped member 62 can thus be affixed with a number of moveable spacers 68 positionable to intersect with cabinets as they are placed within the kitchen cabinet configuration.

Note that the use of Velcro fasteners provide additional flexibility in the design of kitchen cabinetry. Kitchen accessories such as towel racks 70, can openers 72, lights 74, and others can be fastened with such fasteners and repositioned selectively as needed within the kitchen arrangement. Moreover, bookcases and certain items of furniture may also be fixed in place by the present inventive concept. Such fasteners may also be used to provide fastening elements under cabinet shelves to utilize the previously wasted space that normally exists in cabinets just under the bottom portion of a shelf. Leg levellers may also utilize the present invention for permanent positioning under a cabinet floor.

In many instances, end facings 76 for cabinets must be applied over the factory produced cabinet ends in order to match the color, texture, or other decor of the kitchen being developed. Such facings can be attached by the use of Velcro fastening elements rather than with the permanent affixation by screws, staples or the like.

In view of the foregoing description, it is evident that a variety of different types of cabinet configurations can be made utilizing the concept of the present invention and thereby permitting quick sand easy organization or knock-down of the various configurations contemplated. Thus, a completely new approach is provided to an industry traditionally burdened by a labor-intensive installation effort with relatively little flexibility and rearrangement thereafter. Moreover, the present inventive concept lends itself to owner home improvements which are growing at a significant rate in today's market.

As a part of any cabinet arrangement developed as described herein, crown or other decorative molding may be temporarily or permanently installed utilizing the present inventive concept. Velcro-like elements can be secured to the molding and the supporting surface or surfaces and the molding selectively positioned thereafter.

Although one or more embodiments have been shown and described in detail, it will be obvious to those having ordinary skill in the art that the details of construction of these particular embodiments may be modified in a great many ways without departing from the unique concept presented. It is therefore intended that the invention be limited only by the scope of the appended claims rather than by particular details of construction shown except as specifically stated in the claims.

The embodiments of the invention in which an exclusive property or privilege is claimed are defined as follows.

What is claimed is:

1. A cabinet assembly system comprising: one or more cabinet supporting surfaces including vertical walls, ceiling and floor; one or more cabinets having side walls, backs, tops, doors, and a floor; a plurality of spaced fastening elements selectively secured to one or more of said cabinet supporting surfaces and said cabinets, one of said fastening elements being in the form of a plurality of resiliently deformable loops, the other cooperating fastening element being in the form of a plurality of resilient deformable T-shaped hooks adapted to hook into said loops to secure said cabinets to said supporting surface, said fastening elements being interposed between said cabinets and said supporting surfaces and cooperating to inhibit relative movement between said cabinets and said supporting surfaces and hold said cabinets against said supporting surfaces; a U-shaped member having one or more flanges affixed to the supporting surface which partially support the cabinet and cooperatively receive and support said hook or loop elements, and spacer members selectively positioned along the U-shaped member to fill voids between walls of adjacent cabinets.

2. A cabinet assembly system comprising: one or more cabinet supporting surfaces including walls, ceiling and floor; one or more cabinets having side walls, backs, tops, doors, and a floor; a plurality of spaced fastening elements selectively secured to one or more of said cabinet supporting surfaces and said cabinets, one of said fastening elements being in the form of a plurality of resiliently deformable loops, the other cooperating fastening element being in the form of a plurality of resilient deformable T-shaped hooks adapted to hook into said loops to secure said cabinet to said supporting surface, said fastening elements being interposed between said cabinets and said supporting surfaces and cooperating to inhibit relative movement between said cabinets and said supporting surfaces and hold said cabinets against said supporting surfaces; a grooved member affixed to one or more of the cabinets for cooperatively receiving said supporting said hook or loop element; a U-shaped member having one or more flanges affixed to the supporting surface which partially supporting the cabinet and cooperatively receive and support said hook or loop elements; and spacer members selectively positioned along the U-shaped member to fill voids between walls of adjacent cabinets.

* * * * *